United States Patent [19]

Vural et al.

[11] 4,265,130

[45] May 5, 1981

[54] VIBRATION GENERATOR WITH ADJUSTABLE ECCENTRIC WEIGHT

[75] Inventors: Gülertan Vural, Emmelshausen; Udo Carlé, Höhr-Grenzhausen; Manfred Lenkeit, Neuwied, all of Fed. Rep. of Germany

[73] Assignee: Koehring GmbH - Bomag Division, Boppard, Fed. Rep. of Germany

[21] Appl. No.: 75,004

[22] Filed: Sep. 12, 1979

[30] Foreign Application Priority Data

Sep. 15, 1978 [DE] Fed. Rep. of Germany ..... 2840236
Oct. 2, 1978 [DE] Fed. Rep. of Germany ..... 2842937

[51] Int. Cl.[3] ..... B06B 1/16

[52] U.S. Cl. ..... 74/87; 74/578; 366/128

[58] Field of Search ..... 74/61, 87, 578; 173/49; 209/366.5, 367; 366/128; 404/117

[56] References Cited

U.S. PATENT DOCUMENTS

| | | | |
|---|---|---|---|
| 2,902,868 | 9/1959 | Ferrara | 74/87 |
| 3,097,537 | 7/1963 | Peterson | 74/61 |
| 3,386,296 | 6/1968 | Matson | 74/87 |
| 4,121,472 | 10/1978 | Vural et al. | 74/87 |
| 4,127,351 | 11/1978 | Vural | 404/72 |
| 4,168,774 | 9/1979 | Musschoot | 74/61 X |
| 4,211,121 | 7/1980 | Brown | 366/128 X |

FOREIGN PATENT DOCUMENTS

| | | |
|---|---|---|
| 1078058 | 3/1960 | Fed. Rep. of Germany . |
| 1844429 | 12/1960 | Fed. Rep. of Germany . |
| 1845195 | 9/1961 | Fed. Rep. of Germany . |
| 1214616 | 4/1966 | Fed. Rep. of Germany . |
| 1254897 | 11/1967 | Fed. Rep. of Germany . |
| 1484588 | 9/1969 | Fed. Rep. of Germany . |
| 2008055 | 9/1971 | Fed. Rep. of Germany . |

*Primary Examiner*—Allan D. Herrmann
*Attorney, Agent, or Firm*—Spencer & Kaye

[57] ABSTRACT

A vibration generator has a driven excitation shaft on which are fixed two axially-spaced first eccentric weights. A second eccentric weight positioned between the two first eccentric weights also rotates with the excitation shaft but is angularly adjustable thereon about the longitudinal axis of the shaft in order to adjust the vibration amplitude. Such adjustment employs a pawl mounted on one of said first eccentric weights for two-and-fro movement tangentially of a gear ring mounted on said second eccentric weight and with the toothed periphery of which the pawl engages. The second eccentric weight is lockable in adjusted position by a friction disc mounted on said one first eccentric weight and into frictional engagement with which the second eccentric weight is urged by a set of annular disc springs disposed in compression between the second eccentric weight and the other of said first eccentric weights.

33 Claims, 9 Drawing Figures

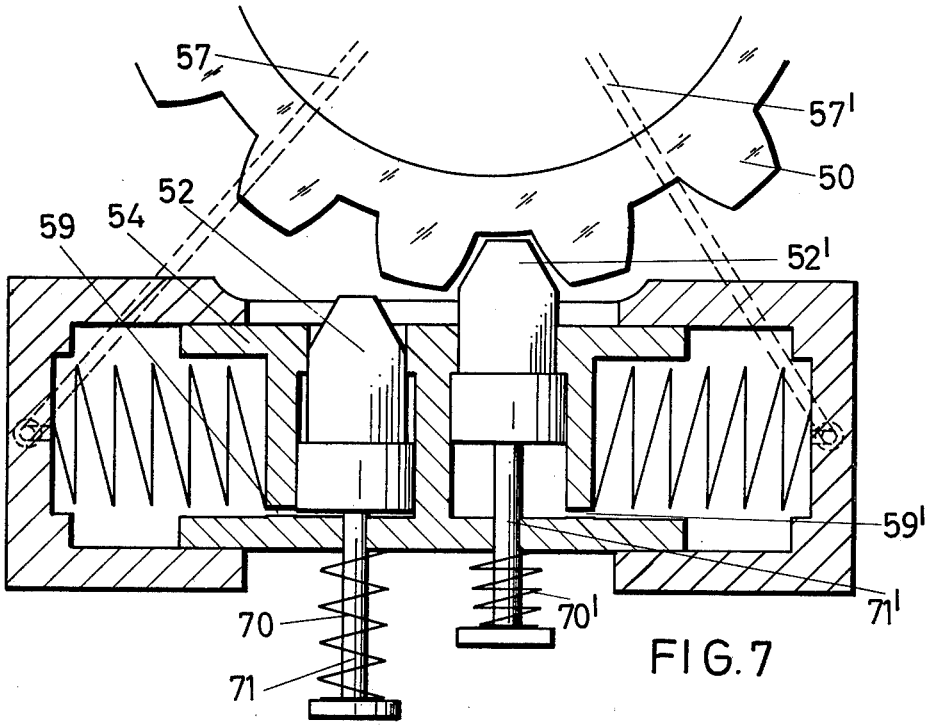
FIG. 7
FIG. 8
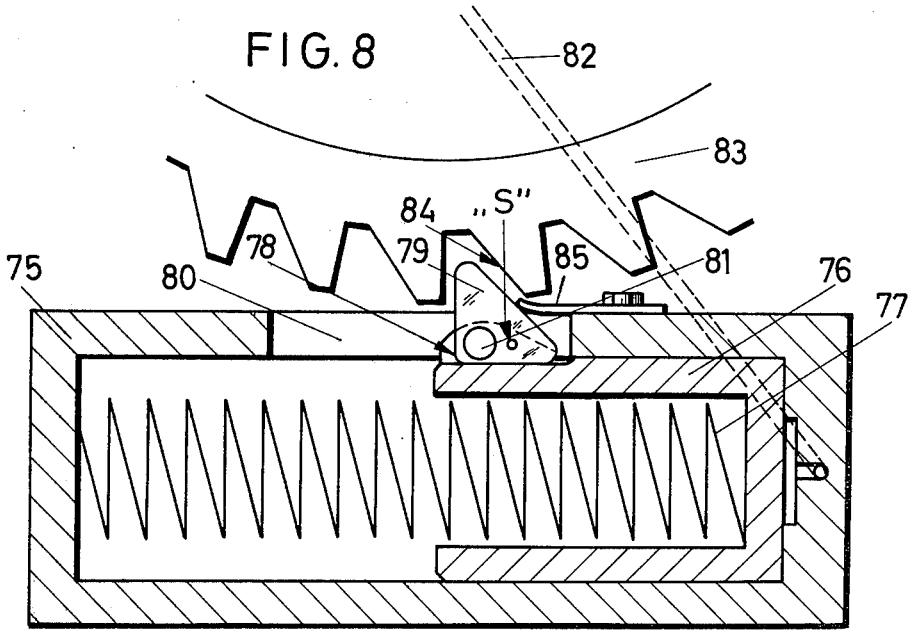

VIBRATION GENERATOR WITH ADJUSTABLE ECCENTRIC WEIGHT

BACKGROUND OF THE INVENTION

1. Field of the Invention

The invention relates to a vibration generator with adjustable eccentric weight having a driven excitation shaft with which there rotates at least one first eccentric weight together with a second eccentric weight which can be adjusted by turning.

2. Description of the Prior Art

Such vibration generators are typically used in conveyors or in ramming tools together with sorting, distribution, metering, compacting, loosening or mixing machines, e.g. in ramming tools, vibratory conveyors, vibratory sieves, vibrating tables etc. For the different applications it is necessary to match the vibration frequency, the vibration amplitude and particularly the excitation force to the individual demands. For this purpose, to adjust the frequency of speed of rotation of the eccentric weights can be altered. The vibration amplitude can be affected by the static torque of the eccentric weights and by alteration of the centrifugal force of the rotary weights the excitation force can be brought to the desired value, for example by adjustment of the eccentricity or by adjustment of the relative phase position of the weights which are fixed to and adjustable on the excitation shaft. If the individual parameters to match the mechanism to the operating conditions are only adjusted when stationary this causes inconvenient interruptions in operation. Apart from this in most cases precise and economical setting of the mechanism can only be effected during operation since because of the quadratic relationship of the excitation force to the rate of vibration a larger number of adjustments will be necessary when stationary, resulting in uneconomic interruptions of work.

A method is known whereby vibration generators with several eccentric weight shafts can have these eccentric shafts turned to vary their relative phase position, thus increasing or reducing the vibration amplitude by vectorial addition or subtraction. Adjustment of the phase position is effected by means of drives, for example epicyclic, bevel gear, differential or worm drives which are expensive to produce and generally do not allow compact construction of a machine. Such complicated drives are also currently to be found on vibration generators having only a single eccentric shaft where there are eccentric weights fixed to and adjustable on the shaft, the relative angle between the two weights, whose eccentricity is generally equal, being variable by these drives. Thus the resulting vibration amplitude can be varied from zero, where the eccentric weights cancel each other out when situated in diametrically opposite positions in relation to the axis of rotation, to a maximum where they are axially in line. Particularly with existing vibration generators with a single eccentric weight shaft and where it is desired to achieve a compact design with easy to handle means to adjust the eccentric weights, the drives as described above generally occupy an appreciable space where costs have had to be kept down.

In order to reduce the complication in the drive for adjusting the relative angle between the eccentric weights a method is known whereby the excitation force of the vibration generator is adjusted dependent on speed, using the centrifugal force of the eccentric weights during operation. (German Patent O.S. No. 25 53 800). With this design the excitation shaft has a portion eccentric to its axis on which the adjustable eccentric weight is mounted with a spring inserted between the fixed weight and the adjustable one acting in the peripheral direction, and acting in opposition to the centrifugal force of the adjustable eccentric weight while running and when not locked so that as the speed is altered angular adjustment can be effected between the two weights. After setting of an angle, locking devices to hold the adjustable weight in position on the excitation shaft are actuated. Although this existing vibration mechanism has essential advantages as regards other known ones as regards its robust and compact construction, reliability and simple and rapid possiblity of adjustment, adjustment of the excitation force which is only possible while working is in many cases found inconvenient.

SUMMARY OF THE INVENTION

The object of the invention is the design of a vibration generator with adjustable eccentric weight of the type described, combining simple construction with precise and reliable adjustment of the weight independent of direction of rotation and particularly independent of speed.

This objective is achieved by means of a gear ring concentric to the excitation shaft on the second eccentric weight which is lockable in different settings and with which gear ring an adjusting pawl mounted on the first eccentric weight and moving to-and-fro in relation to the gearing engages. By the use of the most simple mechanical devices in the shape of gear ring and pawl not only is compact construction and low cost achieved but also the excitation force of a vibration system is simply and reliably adjustable externally as desired. Gearing and pawl can be easily manufactured as separate components and mounted in eccentric weight machines. A particular advantage is easy interchangeability of gearing and pawl which are subject to severe wear when working. In addition existing eccentric weight machines can be simply modified with the aid of the means covered by the invention. Adjustment of the eccentric weights in accordance with the invention is independent of direction of rotation or speed, typically by a simple means of digital supply of a medium under pressure.

Under an advantageous development of the invention provision is made for the second eccentric weight to be spring loaded against a concentric stop face on the first eccentric weight. In particular a friction lining can be formed on the stop face. The spring is ideally constituted by a set of annular disc springs mounted concentrically round the excitation shaft and supported on it. The force/deflection characteristic of the set of disc springs in the selected preloading area is virtually flat. Sets of disc springs with a decreasing force/deflection characteristic show an only smoothly curved characteristic from a certain preloading on, which can be regarded as virtually flat within the area of the preloading loss due to an abrasion of the friction lining. Such sets of disc springs are obtainable from the company Häussermann-Lamellen, D-7300 Esslingen (Neckar), Germany, reference number 2.00/8.003. Using this simple and compact method a second eccentric weight is provided lockable in each position, the set of disc springs acting with a set force against the friction surface of the first eccentric weight. Due to the virtually constant preloading force even with displacements for example resulting from wear of the friction lining, the desired pressure force is maintained. Due to the set amount of friction an involuntary alteration of position or angular adjustment of the two weights as the result of inertia forces is impossible.

The force/deflection characteristic of conventional disc springs generally rises with a slightly depressive characteristic. By contrast under the invention special disc springs are used in which the tension force increases up to a set spring rate, the increase finally becomes steadily less and at the end with further loading a slight reduction in the tension force takes place. This area is used as the preloading deflection whereby a virtually constant spring force is maintained over a set deflection tolerance area.

In a further variation of the invention the second eccentric weight is supported by needle roller bearings on the excitation shaft.

With yet a further variation of the invention provision is made for two first eccentric weights rotating with the excitation shaft, aligned axially and spaced apart with a single adjustable second eccentric weight between them, with the disc springs acting against the first weight which does not have the stop face.

In particular the gear ring is formed at the face of the second eccentric weight towards the stop face on the first eccentric weight.

For easy fitting or dismantling the gear ring can be secured to the second eccentric weight by means of bolts or screws and a flange.

It is particularly advantageous if the pawl engaging in the gear ring is hydraulically actuated. It being in particular moved to-and-fro by a piston-and-cylinder assembly mounted on the first eccentric weight having the stop face. With this the pawl can be accommodated in a transverse drilling in the piston, sliding in it for a predetermined length, its engagement portion protruding sideways through a slot in the cylinder wall, the length of this slot corresponding to the maximum stroke of the piston. In a particularly simple design the piston of the piston-and-cylinder assembly is hydraulically single acting, working against a return spring. The return movement of the piston can be effected by a gas spring formed by a gas chamber on the end of the cylinder not hydraulically pressurised, the piston being sealed off from the gas chamber by means of a membrane.

In particular there can be an axial adjusting screw in the free end face of the gas chamber forming an adjustable stop for the hydraulic piston.

In place of the gas spring however a compression spring can be used acting between the piston face and the end of the cylinder not hydraulically pressurised.

A particularly advantageous and practical version is characterised by the fact that the adjusting pawl itself forms a hydraulic piston working in the piston-and-cylinder assembly, the transverse drilling in the piston forming a further cylinder chamber. Preferably with this the same hydraulic system is used, the adjusting pawl being hydraulically connected to the piston-and-cylinder assembly.

The piston of the piston-and-cylinder assembly can be hollowed out on its hydraulically pressurised side and in the base wall of the hollowed out portion there can be a hydraulic connection to the adjusting pawl.

The transverse drilling in the piston has a stepped portion in it acting as a stop for the adjusting pawl.

In a particularly advantageous version of the invention the adjusting pawl in the transverse drilling in the piston is spring loaded by a compression spring towards the gear ring. This keeps the pawl in engagement with the ring even when no hydraulic force is applied. When the pawl engages fully in the ring an additional locking device is formed in addition to the friction locking device between the fixed and rotary eccentric weights.

In a further version of the invention the gear ring has a saw tooth or ratchet profile, the profile of the engaging portion of the adjusting pawl being correspondingly shaped and having a chamber which on the return stroke of the piston is usable together with the pawl as a ramp, i.e. when the pawl is spring loaded in the transverse drilling. Gear ring and pawl then function as a ratchet.

A vibration generator having a second eccentric weight adjustable in both peripheral directions is preferably provided with a further gear ring, on the second eccentric weight, with a saw tooth or ratchet profile and a further adjusting pawl working in conjunction with it, the saw tooth profile facing in the opposite direction to that of the first gear ring. If as in a preferred version of the invention there are two fixed first eccentric weights, preferably the second adjusting pawl is mounted on the first fixed weight not in frictional contact with the adjustable eccentric weight. Both adjusting mechanisms can be actuated when working as desired, so that when one pawl is actuated the other does not engage in the respective gear ring.

In a further alternative version of a vibration generator adjustable in both directions the gear ring has an involute profile and the ram is hydraulically double acting. In particular there can be a separate control piston for the adjusting pawl, through which medium under pressure is delivered only from the pressurised side of the piston.

Connection to the hydraulic source is preferably so arranged that the hydraulic side of the cylinder of the piston-and-cylinder assembly is connected via a series of drillings in the excitation shaft and the eccentric weights to a hydraulic motor and/or an external source of oil under pressure.

In particular the set of drillings can have an axial drilling in the driven excitation shaft axially aligned with the hollow drilled output shaft of the fixed hydraulic motor or the external stationary source of oil under pressure and the outer end of this drilling joins on to a larger axial drilling in which a plug-in nipple with a peripheral seal is inserted, in turn connected via a flexible hose with the hollow drilled output shaft of the hydraulic motor or the external pressure oil source. With this arrangement the hollow drilled hydraulic motor output shaft is connected with the leak-off chamber of the motor and by corresponding pressurisation of the leak-off connection or by connection of an external pressure oil source to this leak-off pressurisation of the adjusting mechanism at intervals can be easily effected.

An advantageous development is characterised by the fact that the adjusting pawls pivot on the single-acting hydraulic piston of a piston-and-cylinder assembly so that during the return stroke effected by a pressure spring of the piston the adjusting pawl is tilted off by the back of a tooth on the gear ring and engages in the adjacent tooth. With this arrangement the adjusting pawl which is eccentrically attached to the piston can be engaged with the adjacent tooth of the gear ring by the centrifugal force occurring during operation.

Thus in principle the invention covers a rotary two-weight excitation system in which the first weight rotates with the excitation shaft and the second weight is friction coupled to the first to a definite degree and can rotate in relation to it, thus allowing adjustment of the relative angular position and locking the adjustable weight in each setting by means of a set amount of friction. Adjustment is effected independent of direction of rotation or speed by means of a simple method of digital feed of medium under pressure and is either single acting, i.e. in one peripheral direction, or double acting, i.e. in both directions.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

BRIEF DESCRIPTION OF THE DRAWINGS

FIG. 7 shows a further design similar to FIG. 4 with two adjusting pawls; and FIG. 8 shows a further particularly simple design of the invention with a tilting adjusting pawl.

DESCRIPTION OF THE PREFERRED EMBODIMENTS

Figure 1:
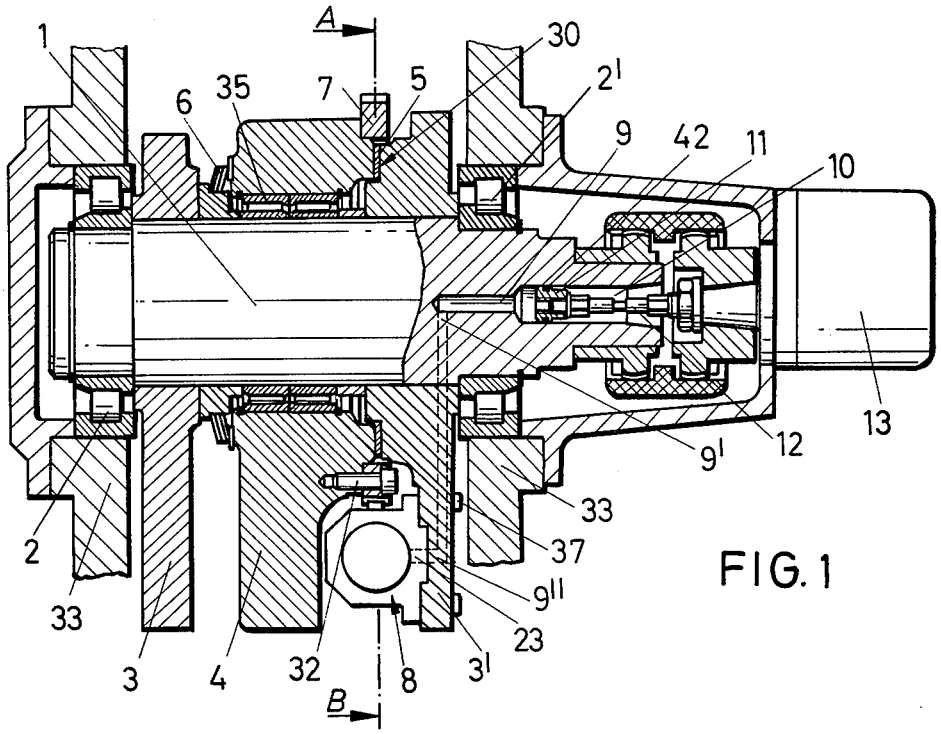
FIG. 1 is an axial section of a vibration generator constructed in accordance with the invention with an adjusting mechanism.

The schematic layout in accordance with FIG. 1 shows a vibration generator, with eccentric weights adjustable in accordance with the invention, in longitudinal or axial section.

The excitation shaft 1 of the vibration generator is axially located on a frame 33 transmitting the vibration by means of roller bearings 2,2'. On the section of the shaft between the bearings three eccentric weights 3, 3' and 4 are mounted, the two first of these weights 3,3' being fixed to the shaft 1 and spaced apart in the axial direction, while the eccentric weight 4 can be rotated in relation to the excitation shaft 1 and is supported on needle roller bearings 35 being situated between the first fixed eccentric weights 3,3'. The adjustable second eccentric weight 4 is urged in the axial direction towards one of the fixed eccentric weights 3' (in FIG. 1 on the right) and against a concentric stop face 30 with a friction lining 5, this lining engaging with a mating face on the second eccentric weight 4.

A set of annular disc springs 6 is mounted concentrically round the excitation shaft 1 and is supported on it or on the other fixed eccentric weight 3 which does not have the stop face 30 for pressing weight 4 toward weight 3'. The set pressure exerted on the friction lining 5 is particularly achieved by disc springs whose force/deflection characteristic is virtually flat over a set range so that changes, for example resulting from wear of the friction lining, do not affect the desired pressure and undesired alteration of position of the two weights which are movable in relation to each other, as the result of inertia forces, does not occur. It can be seen that due to the frictional contact between the two eccentric weights which can be turned in relation to each other it is possible to secure and lock them in each adjusted position.

Figure 2:
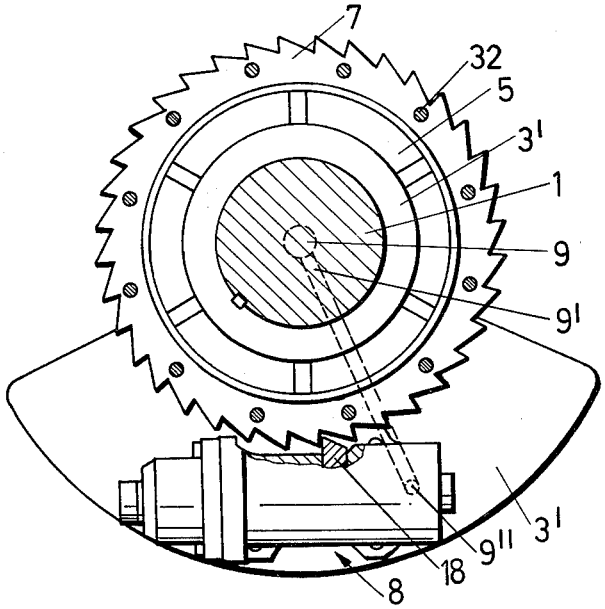
FIG. 2 is a cross-section along the line A–B in FIG. 1.

On the second adjustable eccentric weight 4 and near the face acting against the friction surface on the fixed weight 3' a gear ring 7 is flange mounted, having a continuous saw tooth or ratchet profile round its entire periphery (compare FIG. 2).

An adjusting pawl 18 engages in the gear ring 7 and on actuation, i.e. when reciprocating in the tangential direction in relation to the gear ring at the point of engagement, turns the adjustable weight 4 with the gear ring, overcoming the friction between this weight 4 and the fixed weight 3' for an amount corresponding to the stroke of the pawl 18, thus adjusting the adjustable weight 4 in relation to the two other first weights 3 and 3'. For each stage of adjustment the gear ring 7 is preferably indexed for a single tooth.

Figure 3:
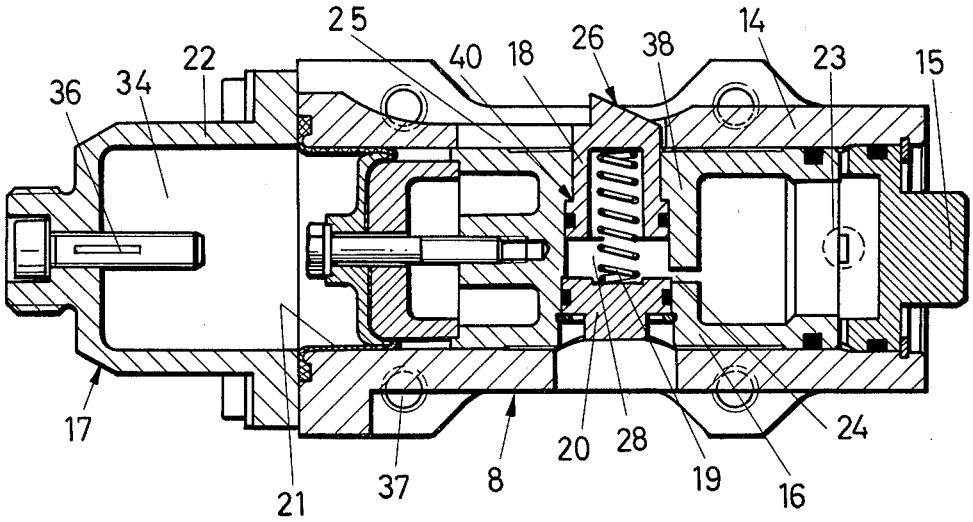
FIG. 3 shows the detail of an adjusting pawl in accordance with FIGS. 1 and 2 with its respective hydraulic connection, to an enlarged scale.

The adjusting pawl 18 is hydraulically actuated and movably accommodated in a hydraulic piston-and-cylinder assembly 8, and specifically, as shown in FIG. 3, in a transverse drilling 28 of the piston 16 of the assembly 8, the piston 16 in turn reciprocating in the assembly 8.

The construction of the assembly 8 which is attached by screws 37 to the fixed eccentric weight 3' on the right in FIG. 1 is shown in greater detail in FIG. 3. The arrangement comprises a cylinder housing 14 in which the piston 16 containing the transverse drilling 28 slides.

The piston 16 is hydraulically pressurised on one side via a hydraulic passage 23 in the cylinder housing 14 (in FIG. 3 on the right), and the cylinder housing 14 is closed at the end at the hydraulic side of the piston 16 by means of a plug 15 to prevent the escape of fluid.

On the other side of the piston, not hydraulically pressurised, is a return spring 34 in the form of a gas spring. This is formed by a gas spring chamber 17 in the form of a cap 22 forming a gas-tight seal at the end of the cylinder housing. The gas chamber 17 which is preferably filled with nitrogen as the spring medium, is sealed from the piston face facing towards it by means of an elastic membrane 21. In the free end face of the gas chamber 17 is an axial adjusting screw 36 forming a definite stop for the hydraulic piston 16, so that the maximum stroke of the piston and thus the maximum reciprocating movement of the adjusting pawl 18 is adjustable.

In an alternative design, in place of the gas chamber 17 a mechanical spring for example a compression spring can be used as the return spring 34, to return the single-acting hydraulic piston.

The adjusting pawl 18 which reciprocates in the transverse drilling 28 at right angles to the direction of movement of the piston 16 protrudes sideways from the piston-and-cylinder assembly, through a slot 25 in the cylinder wall 14, in order to engage in the gear ring 7. The axial length of the slot 25 determines the piston stroke.

The adjusting pawl 18 in the example shown in FIG. 3 is preloaded by a compression spring 19 in the direction of the gear ring 7 and when fully engaged it abuts a concentric step 40 in the transverse drilling of the piston 16.

The piston 16 is hollowed out at both ends and has in the base wall 38 on the hydraulic side a hydraulic passage for the adjusting pawl 18, which for its part operates as a piston with corresponding seals. The transverse drilling 28 in the piston 16 acts as a further cylinder and is pressurised via the hydraulic passage 24 by the same hydraulic medium as is used to actuate the piston 16. A sealing member 20 forms a hydraulic seal for the transverse drilling at its end which is not used for the pawl 18 to pass through in order to engage with the gear ring 7.

Pressurisation of the adjusting mechanism comprising the pawl 18 by the same hydraulic medium as is used to actuate the piston 16 has the advantage that the adjusting operation can also be carried out with the excitation system rotating, and that the adjusting pawl 18 is always held in engagement in opposition to centrifugal force. By preloading of the adjusting pawl 18 by means of the compression spring 19 in the direction of the gear ring and when the engaging portion of the adjustable pawl 18 is extended to the maximum an additional locking device is formed for the adjustable eccentric weight, aiding the frictional coupling already existing. This locking device also is effective if the hydraulic system is unpressurised. Thus an additional locking system is formed giving a fixed adjustment even in the event of failure of the first locking system employing the friction coupling due to wear of the friction lining.

Referring again to FIG. 1, pressurisation of the piston-and-cylinder assembly 8 is preferably best effected by a set of drillings 9, 9′, 9″ in the excitation shaft 1 and the first fixed eccentric weight 3′, the set of drillings 9, 9′, 9″ being connected at the piston end with a hydraulic union defining passage 23 in the cylinder wall 14 of the assembly 8, while the external supply of medium under pressure is effected by a plug-in nipple 11 inserted in an axial drilling 10 wider than the axial drilling 9 with a peripheral seal 42 and connected by a flexible hose 12 to the hollow drilled driven shaft of a hydraulic motor 13, the hollow drilled driven shaft of the hydraulic motor being connected to the motor leak-off chamber. The hydraulic motor 13 may be a gear-motor as described in connection with FIG. 5 and claims 6 to 8 of U.S. Pat. No. 4,121,472. The driven shaft of the hydraulic motor 13 and the excitation shaft 1 are not rotationally coupled with one another. There is provided a sealing bridge only between their ends which do not rotate relative to one another. By corresponding pressurisation of the leakage discharge pressurisation of the adjusting mechanism at intervals can be simply effected.

The hydraulically-operated adjusting pawl 18 described above is single acting, i.e. it allows adjustment of the adjustable eccentric weight 4 in one peripheral direction.

On relief of pressure the return spring 34 of the piston 16 moves the adjusting pawl 18 from the maximum position (on the left in FIG. 3) back into the starting position in which the engagement portion of the adjusting pawl 18 engages with the chamfer 26 on a following tooth of the gear ring, due to the preloading of the adjusting pawl 18 by means of compression spring 19, so that if necessary a new adjusting movement can be effected.

Figure 4:
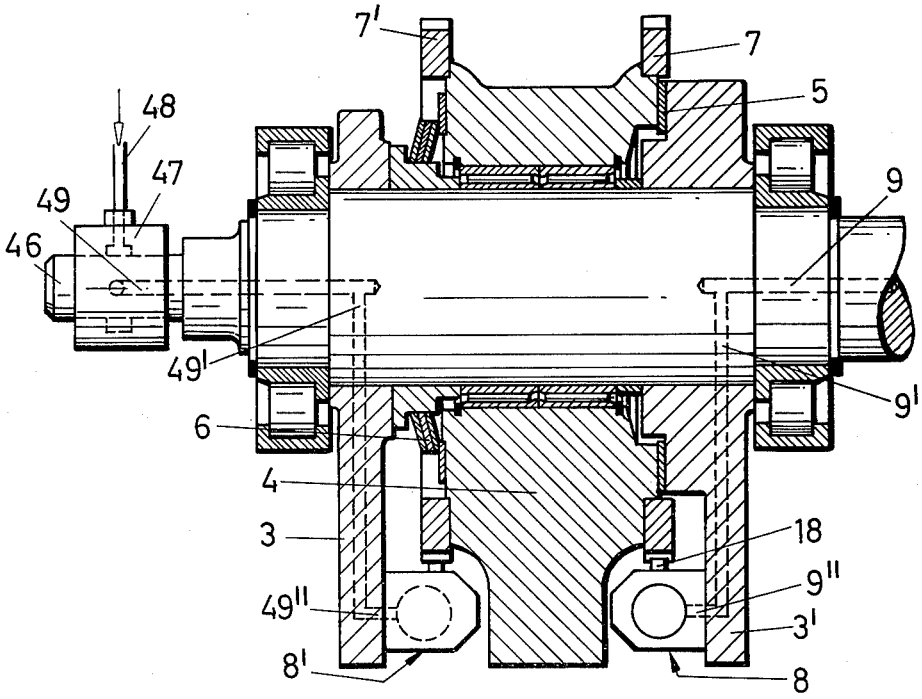
FIG. 4 shows a different design in accordance with the invention and with an additional gear ring and respective adjusting pawl to allow adjustment in both peripheral directions.

With a preferred version of the invention a double-acting adjustment is provided i.e. adjustment of the adjustable eccentric weight 4 in both peripheral directions. With this design (see FIG. 4) in addition to the saw tooth ring 7 referred to above with its adjusting pawl 18 a further gear ring 7′ with teeth facing in the opposite direction and its second adjusting piston-and-cylinder assembly 8′ is provided, mounted on the first fixed eccentric weight 3. The supply of medium under pressure for the second adjusting cylinder is effected from the free shaft end via a standard rotary seal coupling from a separately controlled pressure source, i.e. at the free shaft end 46 furthest from the motor is a rotary coupling 47 as shown in FIG. 4. The supply is from an external pressure source not shown in the figure via a pipe 48, the rotary coupling 47, and a drilling system 49, 49′, 49″ to the piston-and-cylinder assembly 8′.

Figure 5:
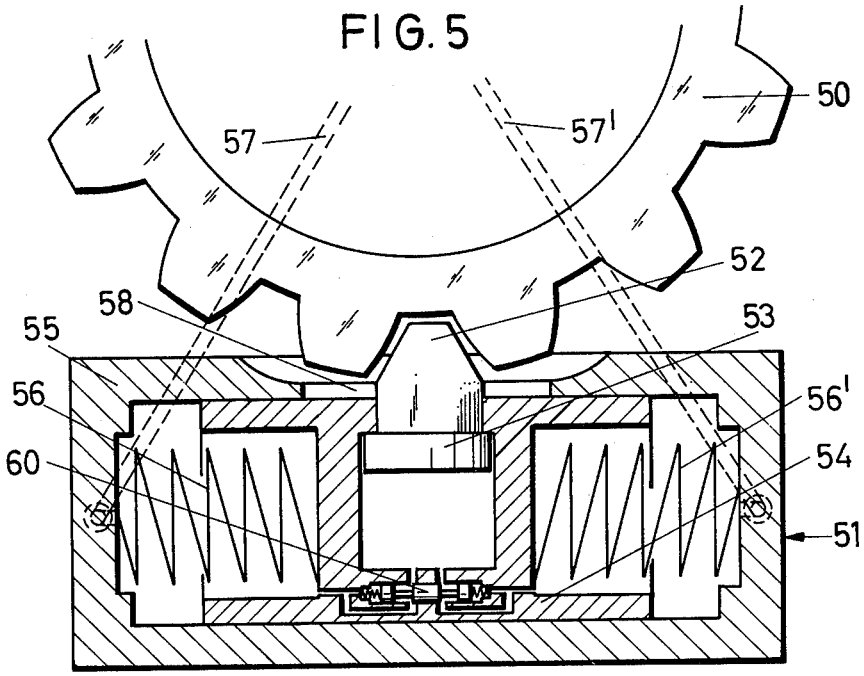
FIG. 5 shows an additional design of a reversible adjusting mechanism with a single gear ring with involute profile and double-acting hydraulic piston together with a separate control piston.

FIG. 5 gives a further example of a reversible adjusting mechanism with gear ring having an involute profile and a double-acting ram. A single gear ring 50 here works with the piston-and-cylinder assembly 51, the adjusting pawl 52 having an engagement portion fitting the involute profile of the gear ring and working in the gap between adjacent teeth of the gear ring 50. The adjusting pawl 52 has at its base a piston 53 sliding in the transverse drilling of the hydraulic piston 54 and pressurised from both sides of the piston 54 via a separate small control piston 60, whose function is explained in connection with FIG. 6. The stroke which piston 54 must undergo relative to the tooth pitch of gearing 50 must be substantially equal to the tooth pitch.

The piston 54 slides in the cylinder housing 55 and is centred by means of the preloaded compression springs 56, 56′. Pressurisation of the piston 54 is effected, dependent on the desired direction of adjustment, via drilling 57 or 57′, the means of supplying the medium under pressure being analagous to the designs previously described. If for example the gear ring is to be rotated in the clockwise direction fluid under pressure is directed via drilling 57′ to the righthand side of the piston 54 and simultaneously via the control piston 60 to below the piston 53 of the adjusting pawl 52. This extends, the piston 54 travels to the left as far as the stop and the gear ring is indexed for one tooth, the pawl sliding in a slot 58 in the cylinder. The medium in the lefthand cylinder chamber as shown in the drawing is forced out unpressurised via drilling 57. After adjustment pressure is also relieved in the drilling 57′ and the adjusting pawl comes free of the teeth under the effect of the centrifugal force acting on it, forcing the medium out while the centring spring 56 brings the piston 54 back into the rest position.

For adjustment in the opposite direction the process is effected in the opposite manner.

Figure 6:
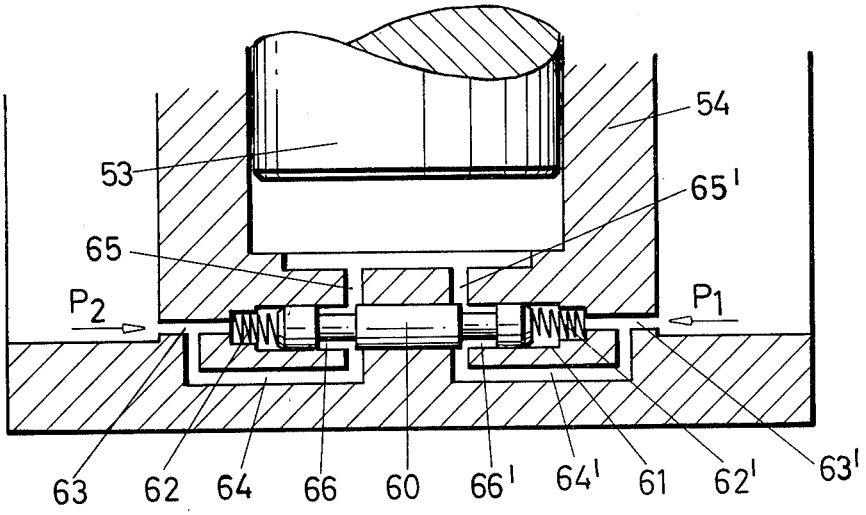
FIG. 6 is a detail view in accordance with FIG. 5 in the area of the separate control piston.

FIG. 6 shows an enlarged detail of a portion of piston 54 below the transverse drilling, which accommodates the pawl piston 53. In the base of the transverse drilling is the small control piston 60 sliding in a cylindrical chamber 61 and centred by means of pressure springs 62 and 62′. If pressure $P_1$ is applied from the righthand side of the piston 54 as shown in the drawing, the medium flows through the drillings 63′ over the end face of the control piston 60 thrusting this to the left in opposition to spring 62 against the stop. The result is that the interconnection of drillings 64 and 65 is interrupted by the central sleeve portion of the piston 60 while the medium can flow through drilling 64', annular passage 66' and drilling 65' under the piston 53 to extend the pawl. After adjustment has been effected spring 62 returns control piston 60 to the central position and the quantity of pressure medium below the pawl piston 53 can flow away unpressurised via both drilling systems.

On pressurisation with $P_2$ (from the left as shown in FIG. 6) the function takes place in the opposite direction.

FIG. 7 shows a further version similar to that in FIG. 5, the piston-and-cylinder assembly being equipped with two adjusting pawls 52 and 52'. Each pawl piston is pressurised by a drilling 59 and 59' from the appropriate piston side with fluid so that the righthand pawl 52' when turning the gear ring in the clockwise direction is extended, while the lefthand pawl 52 operates for adjustment in the opposite direction. Return of the pawls after adjustment is effected, here typically by compression springs 70 and 70' engaging with extension bolts 71 and 71' which pass through the wall of the piston 54.

Of course, with the design of FIG. 5 also, return of the adjusting pawl 52 in accordance with the design of FIG. 7 can be effected by a spring in combination with the control piston 60.

FIG. 8 shows a particularly simple version of the invention with a pivoting adjusting pawl 79. With this version the reciprocating single-acting piston 76 is held by a spring 77 in the unpressurised condition against the righthand stop end of a cylinder 75 while the shank of the open piston 76 has at the top a bolt mounting 78 acting as a pivot for the adjusting pawl 79. The bolt mounting 78 slides at the side in a slot 80 in the cylinder.

The pawl 79 is so shaped that its centre of gravity S is situated on the right near the bearing bolt 81. This ensures that when the machinery is rotating centrifugal force maintains the pawl at all times in the upright position shown. If the piston is now pressurised through the drilling 82 the piston 76 moves in opposition to the spring and the pawl 79 indexes the gear ring 83 for a tooth in accordance with the piston stroke. On cessation of pressure the spring 77 returns the piston 76 to the starting position. This causes the pawl 79 to tilt as it runs over the back of a tooth and disengage, the pawl being guided behind the next tooth with which it snaps into engagement.

A further development in FIG. 8 shows the provision of a spring member 85 which is fixed to the outer wall of the cylinder 75 and which is biassed by its spring end against the back of the pawl 79. Thus at one point the spring member abuts the back of the pawl so that the force exerted by the spring bias on the pawl moves or holds the latter to or in the engaged position. If the spring member 85 is fitted it is unnecessary for the pawl 79 to be designed and positioned so that the centre of gravity of the pawl 79 returns it to the engaged position as in FIG. 8. The spring member ensures that the pawl 79 is in the engaged position when the adjustment has been effected as in FIG. 8.

Figure 9:
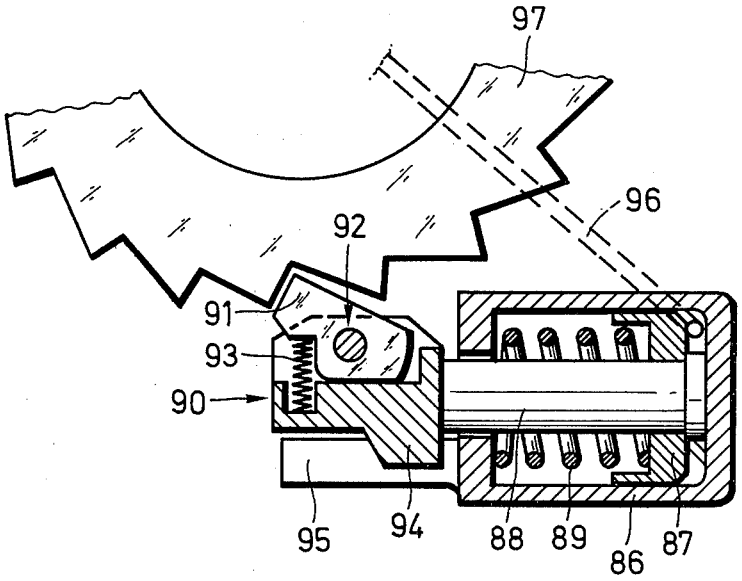
FIG. 9 shows another particularly reliable design of the invention, with a rocking preloaded adjusting pawl.

In FIG. 9 a further reliable version of the invention with a rocking adjustment pawl 91 is shown. In this version also, as shown in FIG. 8, a reciprocating piston 87 which is hydraulically pressurised on one side is held by a compression spring 89 in the unpressurised state against the righthand stop of a cylinder 86. A piston rod 88 is fixed to the crown of the piston 87 and extends to the outside through the compression spring 89 and a slide-guide opening in the end of the cylinder 86 which is opposite to the stop. At the free end of the piston rod 88 a head piece 90 is mounted, on which the end of the adjusting pawl 91 towards the gear ring pivots on a mounting bolt 92. A spring member in the form of a compression spring 93 is supported at one end in a recess in the head piece 90 and at the other end on a supporting boss of the adjusting pawl 91, and this spring 93 preloads the adjusting pawl into the engaged position. In addition, the head piece 90 has on the side opposite the adjusting pawl 91 a prismatic boss 94 acting as a guide member and sliding in a guide rail 95 which is fixed to the cylinder 86. Pressurisation of the piston 87 takes place via a drilling 96.

The method of operation of the design shown in FIG. 9 is similar to that shown in FIG. 8. On the return stroke of the piston to the starting position, the adjusting pawl is likewise rocked by riding up the back of an adjusting tooth, freed from engagement and then returned into the engaged position behind the next tooth by means, in the version in FIG. 9, of the spring member 93, in the same manner as happens with the spring member 85 in the version of FIG. 8.

The hydraulic pressure to the, or each, cylinder chamber is supplied by any suitable pressure source having an associated low pressure side, or reservoir together with valves arranged to selectively connect the, or each, cylinder chamber to either the high pressure side or the low pressure side of the source. Such valves may be controlled manually but preferably are controlled automatically by solenoids. It would be possible to control the application of hydraulic pressure to the, or each cylinder chamber and the relief of such hydraulic pressure in a programmed manner similar to that described in U.S. Pat. No. 4,127,351.

The foregoing description of preferred embodiments of the invention is given here by way of example only. The invention is not to be taken as limited to any of the specific features as described but comprehends all such variations thereof as come within the scope of the appended claims.

We claim:

1. A vibration generator comprising a driven excitation shaft, at least one first eccentric weight fixed to and rotatable with said shaft, a second eccentric weight which is also rotatable with said shaft while being adjustable relatively thereto, a gear ring on said second eccentric weight and concentric with the excitation shaft, and an adjusting pawl which is movable to-and-fro tangentially of said gear ring and which is mounted on said first eccentric weight and in engagement with the gear ring, said second eccentric weight being lockable in each adjusted position.

2. A vibration generator as claimed in claim 1, wherein the second eccentric weight is spring loaded against a concentric stop face on the first eccentric weight.

3. A vibration generator as claimed in claim 2, wherein a friction lining is provided on the stop face.

4. A vibration generator as claimed in claim 2, wherein said second eccentric weight is spring loaded by a set of annular disc springs mounted concentrically around the excitation shaft and is supported by this set of springs.

5. A vibration generator as claimed in claim 4, wherein the force/deflection characteristic of the disc springs is effectively constant in the relevant preloading range.

6. A vibration generator as claimed in claim 1, wherein the second eccentric weight is mounted by means of needle roller bearings on the excitation shaft.

7. A vibration generator as claimed in claim 4, wherein said one first eccentric weight is one of two axially aligned and spaced apart first eccentric weights on the excitation shaft and rotatable with it, a single adjustable second eccentric weight is provided situated between said two first eccentric weights and the disc springs act against the first eccentric weight which does not possess the stop face.

8. A vibration generator as claimed in claim 1, wherein said gear ring is disposed on a side face of the second eccentric weight which is directed towards a stop face on the first eccentric weight.

9. A vibration generator as claimed in claim 8, wherein the gear ring is flange mounted on the second eccentric weight by means of bolts.

10. A vibration generator as claimed in claim 1, wherein said adjusting pawl is hydraulically operated.

11. A vibration generator as claimed in claim 8, wherein the pawl is hydraulically operated, is supported by a piston-and-cylinder assembly fixed to the first eccentric weight having the stop face, and is moved to and fro by the piston-and-cylinder assembly.

12. A vibration generator as claimed in claim 11, wherein the pawl is accommodated in a transverse drilling in the piston of the piston-and-cylinder assembly and slides in it over a predetermined length, and the engagement portion of the pawl protrudes sideways through a slot in the cylinder wall, the length of the slot corresponding to the maximum stroke of the piston.

13. A vibration generator as claimed in claim 11, wherein the piston is hydraulically actuated in one direction, acting against a return spring.

14. A vibration generator as claimed in claim 13, wherein the return spring is a gas spring formed by a gas chamber on the non-hydraulic end of the cylinder of the piston-and-cylinder assembly, the piston being sealed from the gas chamber by a membrane.

15. A vibration generator as claimed in claim 14, wherein in the free end face of the gas chamber an axial adjusting screw is accommodated, this screw forming a stop for the hydraulic piston.

16. A vibration generator as claimed in claim 13, wherein the return spring is a compression spring supported on the face of the piston and on the non-hydraulic end face of the cylinder of the piston-and-cylinder assembly.

17. A vibration generator as claimed in claim 1, wherein the adjusting pawl in the piston-and-cylinder assembly itself forms a further hydraulically-operated piston, and a transverse drilling in the piston of said assembly accommodates the pawl piston and is in the form of a further cylinder.

18. A vibration generator as claimed in claim 17, wherein the adjusting pawl is hydraulically connected to the piston-and-cylinder assembly.

19. The vibration generator as claimed in claim 18, wherein the piston of the piston-and-cylinder assembly is hollow on its hydraulically-pressurised side, and in the base wall of the hollowed-out portion a hydraulic passage is formed to the adjusting pawl.

20. A vibration generator as claimed in claim 12, wherein a transverse drilling in the piston of the piston-and-cylinder assembly has a stepped portion acting as a stop for the adjusting pawl.

21. A vibration generator as claimed in claim 12, wherein said adjusting pawl is preloaded in the transverse drilling in the piston of the piston-and-cylinder assembly, in the direction of the gear ring, by means of a compression spring.

22. A vibration generator as claimed in claim 1, wherein the gear ring has a saw tooth or ratchet profile shaped to correspond with the engaging portion of the adjusting pawl, together with a chamfer functioning as a ramp on the reverse stroke of the piston in conjunction with the pawl.

23. A vibration generator as claimed in claim 22, wherein on the second eccentric weight a further gear ring with saw tooth or ratchet profile is provided and a further adjusting pawl is operatively associated with this gear ring, the saw tooth profile of which faces in the reverse direction as compared with that on the first gear ring.

24. A vibration generator as claimed in claim 11, wherein the gear ring has an involute profile and the piston-and-cylinder assembly is hydraulically double acting.

25. A vibration generator as claimed in claim 24, wherein a separate control piston is provided for the adjusting pawl, through which control piston fluid under pressure is supplied only from the pressurised side of the piston of said piston-and-cylinder assembly.

26. A vibration generator as claimed in claim 11, wherein the hydraulic side of the cylinder of the piston-and-cylinder assembly is connected by a set of drillings in the excitation shaft and the eccentric weight to a hydraulic motor and/or to an external source of oil under pressure.

27. A vibration generator as claimed in claim 26, wherein the set of drillings includes an axial drilling in the excitation shaft axially in line with the hollow drilled output shaft of a fixed hydraulic motor or with the external stationary source of oil under pressure, and that the outer end of the axial drilling joins on to a larger axial drilling into which a plug-in nipple with a peripheral seal is fitted, in turn connected via a flexible hose with the hollow drilled output shaft of the hydraulic motor or the external source of oil under pressure.

28. A vibration generator as claimed in claim 1, wherein the adjusting pawl pivots on the single-acting hydraulic piston of an actuating piston-and-cylinder assembly so that during the return stroke effected by a compression spring of the piston the pawl is tilted by the back of a tooth of the gear ring and engages with the adjacent tooth.

29. A vibration generator as claimed in claim 28, wherein the adjusting pawl is eccentrically attached to the piston and is engaged with the gear ring by centrifugal force during operation of the generator.

30. A vibration generator as claimed in claim 28, wherein the adjusting pawl is biassed and held in the engaged position by a spring member.

31. A vibration generator as claimed in claim 28, wherein the adjusting pawl is pivotally mounted on a head piece of a piston rod outside the cylinder, said rod passing through the compression spring and being rigidly fixed to the piston which is hydraulically pressurised on one side.

32. A vibration generator as claimed in claim 31, wherein the adjusting pawl is preloaded into the engaged position by means of a spring member which is supported on the head piece.

33. A vibration generator as claimed in claim 32, wherein the head piece has a prismatic guide extension sliding in a guide rail which is connected to the cylinder.

* * * * *